United States Patent [19]

Knappe

[11] Patent Number: 4,703,834

[45] Date of Patent: Nov. 3, 1987

[54] MULTIPLY EXTENSIBLE LIFT FRAMES

[75] Inventor: Kürt Knappe, Sulzbach, Fed. Rep. of Germany

[73] Assignee: Linde Aktiengesellschaft, Wiesbaden, Fed. Rep. of Germany

[21] Appl. No.: 774,065

[22] Filed: Sep. 9, 1985

[30] Foreign Application Priority Data

Sep. 14, 1984 [DE] Fed. Rep. of Germany ..... 3433862

[51] Int. Cl.[4] ..... B66B 9/20

[52] U.S. Cl. ..... 187/9 E; 414/631

[58] Field of Search ..... 187/9 R, 9 E; 414/629, 414/631; 254/89 R, 89 H; 137/355.16, 355.17

[56] References Cited

U.S. PATENT DOCUMENTS

| | | | |
|---|---|---|---|
| 3,394,778 | 7/1968 | Brinton | 187/9 E |
| 4,531,615 | 7/1985 | Wible | 187/9 E |

FOREIGN PATENT DOCUMENTS

| | | | |
|---|---|---|---|
| 0008958 | 1/1978 | Japan | 187/9 E |
| 630168 | 10/1949 | United Kingdom . | |
| 654866 | 6/1952 | United Kingdom . | |
| 890987 | 3/1962 | United Kingdom . | |
| 1031772 | 6/1966 | United Kingdom . | |
| 1067050 | 4/1967 | United Kingdom . | |
| 1182962 | 4/1970 | United Kingdom . | |
| 1196624 | 7/1970 | United Kingdom . | |
| 1487889 | 10/1977 | United Kingdom . | |
| 2058012 | 4/1981 | United Kingdom . | |
| 2118140 | 10/1983 | United Kingdom . | |

*Primary Examiner*—Joseph J. Rolla
*Assistant Examiner*—Kenneth Noland
*Attorney, Agent, or Firm*—Buell, Ziesenheim, Beck & Alstadt

[57] ABSTRACT

A multiply extensible lifting frame is provided having a standing mast and one or more middle and inner masts slidable relative to one another, at least one lifting press cylinder connected with the standing mast having a piston connected to the intermediate mast, at least one chain connected at one end with the standing mast and at the other end with the inner mast and supported over a roller on the middle mast, a second lifting press connected with the inner mast and carrying a chain over a roller thereon, the chain connected at one end to the inner mast section and at the other end to the lift slide the improvement in which the at least one chain is carried in a plane parallel to the longitudinal median plane of the vehicle, at the at least one lifting press cylinder is in the same plane, and a lateral boom to which the at least one chain is fastened, is fastened at the lower end of each inner mast column.

2 Claims, 2 Drawing Figures

MULTIPLY EXTENSIBLE LIFT FRAMES

Figure 2:
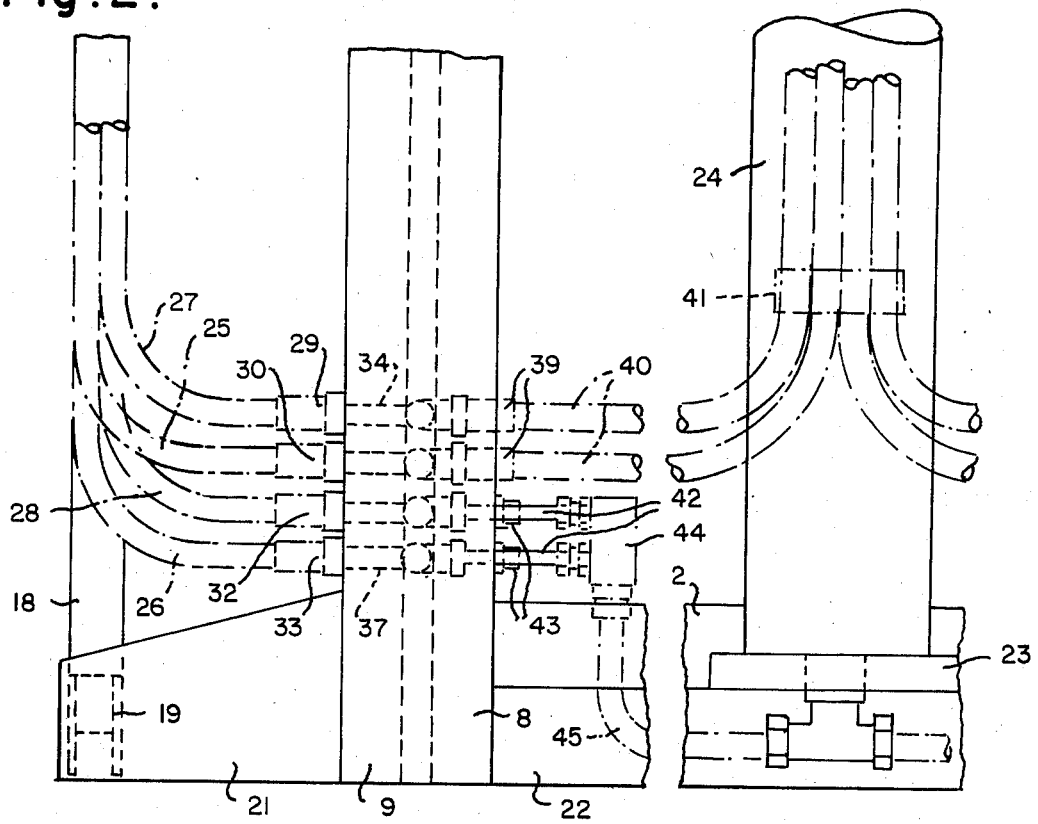

This application is related to my application, Ser. No. 774064, filed concurrently herewith and now U.S. Pat. No. 4,620,614.

This invention relates to multiply extensible lift frames and particularly to multiply extensible lifting frames for lift loaders with a standing mast connected with the lift loader frame directly or indrectly and a middle mast section capable of sliding against the standing mast connected with the lift loader section capable of sliding against the middle mast section, with each mast section having two lateral columns, and with at least one lifting press cylinder connected with the standing mast, the piston rod of the piston connected with the middle mast and having at least one chain connected at one end with the standing mast and at the other end with the lower end of the inner mast, the chain being carried over a roller supported on the middle mast section, a second lifting press cylinder connected with the inner mast section, a roller on the second press, a chain conveyed of this roller fastened at one end of the innere mast section and at the other end of the left side, with the lift press cylinder connected to the standing mast being located on the outside along a column of the standing mast section.

In the lift frameworks of this type which are known to date the chain is located in the vicinity of the column of the inner mast section. Due to this arrangement, the chain lies in the space that would be free for the operator of the lift loader to see through if the chain was not there. In most cases a lifting press is located laterally on the outside beside each of the two standing mast columns. If the column has one or preferably two flanges that project outward, the impairment of the field of vision is minimized if the lifting press is located alongside the flange or between the flanges of the standing mast column. The invention proposes to locate the chain by which the inner mast section is raised with respect to the middle mast section when the latter is raised such that the vision conditions are impaired as little as possible and preferably not at all.

This problem is solved by providing that the one chain carried in a plane parallel to the longitudinal median plane of the vehicle on which the framework is carried, with the lifting press in the same plane and a lateral boom, to which the first chain is fastened, fastened at the lower end of each column of the inner mast section. Since the chain lies in a plane with the lifting press cylinder, it does not impair the vision conditions because it lies in the shadow of the lifting press cylinder. There is also the advantage that the line of force action of the force exerted by the chain on the roller over which the chain runs follows a course in or at least in the vicinity of the axis of the piston rod of this lifting press, such that no or only slight bending stresses result for the piston rod. Another essential advantage results with respect to the production and bearing system in that the standing masts can be identical in the case of a single extensible, a double extensible and a triple extensible mast and also that the inner mast section and the middle mast section are identical up to the supplementary upper rollers and/or all the components of the overall lifting apparatus are identical in the case of a single extensible mast and a triple extensible mast, such that these identical parts can be produced in a correspondingly larger number, using methods that facilitate less expensive production and accordingly fewer mast components have to be held in reserve as spare parts.

Another essential advantage results from the further inclusion of rollers carried on the columns of the inner mast section and/or the lift slide is capable of being displaced close by the inner side or front side of the columns, and in which the hoses for an additional hydraulic system and/or an additional lifting press cylinder are carried in the same plane running parallel to the longitudinal median plane of the vehicle in which the one chain is also carried, and each hose being connected with a connection inserted into a borehole that empties at the side of the front flange of the column of the inner mast section and also at the back side of the same column of the inner mast section, and a connection, to which a line that leads to the cylinder of the second lifting press or a line, leading to an additional hydraulic system is connected, is screwed into this second mouth of the borehole. While up to now hoses that are fastened to the standing mast section and also to the inner mast section had to be connected to the cylinder of the inner mast section, by the loading of which the lift slide can be raised, and have to be located independently in some manner, there is thus the possibility of carrying the hoses in the same plane as the chain and effecting a borehole from these hoses running parallel to the chain through the column of the inner mast section to a connection that is located on the back side, i.e , on the rear end face or on the lateral flange surface of the column of the inner mast section and thus moves with the inner mast section. The hoses cannot however be conveyed on the outside around the inner mast section, because the rollers of the lift slide are supported there against the inner mast section and/or the lift slide itself is led past in only slight spacing on the columns of the inner mast section.

Figure 1:
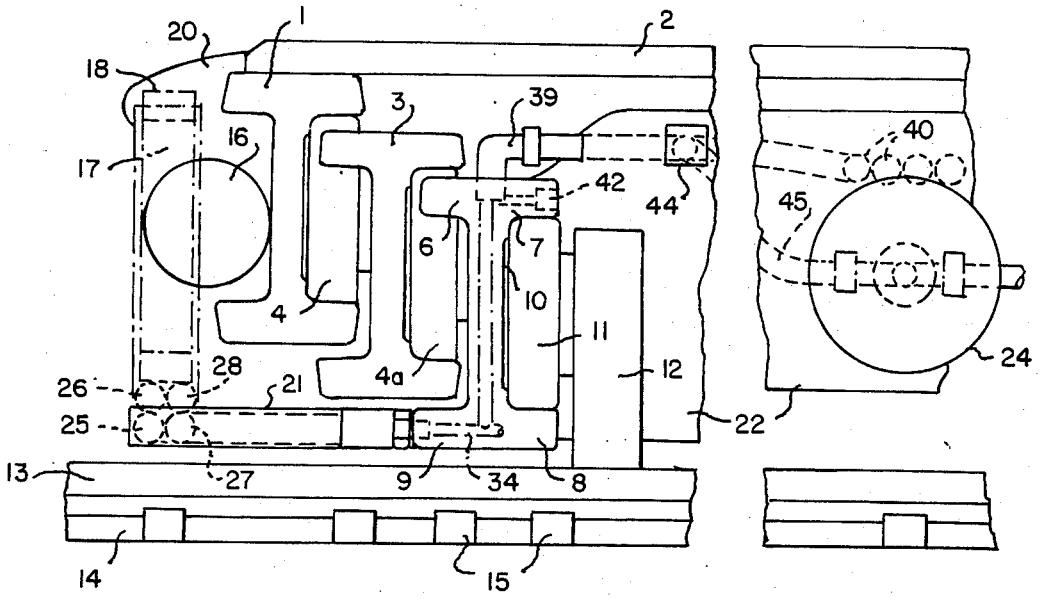

In the foregoing general description of my invention, I have set out certain objects, purposes and advantages of this invention. Other objects, purposes and advantages of this invention will be apparent from a consideration of the following description and the accompanyng drawings in which:

FIG. 1 shows a plan view on one half of the lifting frame extending up to the plane of symmetry; and FIG. 2 shows a front view of the same lifting frame, in which the contours of the columns of the standing mast section and the middle mast section and the cylinder of the lifting press are left out for the sake of simplifying the drawing.

The column of the standing mast section consists of a double-T section and is connected through a cross bar 2 with a like column on the other side of the lift frame. The column 3 of the middle lift frame, which is supported against column 1 by means of roller 4 that is supported on the column 3 and runs between the flanges of column 1, is capable of sliding against the standing mast column 1. The column 5 of the inner mast section also consists of a double T section with the two rear flanges 6 and 7 and the two front flanges 8 and 9 and the web 10. The roller 4*a* is supported on the web and it carries the column 6, 7, 8, 9, 10 on the column 3. The roller 11 is carried between the two flanges 7 and 8; it is supported on the fork carrier side section 12, which is connected with the fork carrier 13, which has a holding web 14 on its upper side that has notched recesses 15 in the usual manner.

The lifting press cylinder 16 is located between the two flanges of the standing mast column 1 that projects outward. A piston rod that is not shown in the drawing is capable of being extended upward from the lifting press cylinder 16. A sprocket wheel 17, which is indicated only by dashed lines in FIG. 1, is connected with the piston rod. The chain 18, whose rear stringer in the drawing is connected by means of an adjustable chain anchor (not shown in the drawing) with a boom 20, which is rigidly connected with the crosspiece 2, is carried over the sprocket wheel 17.

A boom 21, to which the front stringer of the chain 18 is fastened by means of a second chain anchor 19, is rigidly connected with the front flange 9 of the column 6, 7, 8, 9, 10 of the inner mast section.

The piston rod extensible from the lifting press cylinder 16 is also connected with the column 3 of the middle mast section in a manner not shown in the drawing.

The mechanism of operation is as follows: If the lifting press cylinder 16 is loaded with pressure, the piston rod moves out from it and thus lifts the middle mast section 3. At the same time, however, the sprocket wheel 17 is also raised. Because the chain 18 is connected on the one hand through the boom 20 with the crosspiece 2 and is carried on the other hand over the sprocket wheel 17, the front stringer of the chain 18 must be lifted with twice the speed as the middle mast section and its column 3. Because the front stringer of the chain 18 is rigidly connected through the boom 21 with the column 6, 7, 8, 9 10 of the inner mast section, this inner mast section is thus lifted with a speed that is twice as great as the lifting speed with which the middle mast section 3 is lifted.

The chain 18 lies here in a plane parallel to the longitudinal median plane of the vehicle and projects hardly at all toward the side over the lifting press cylinder, such that the field of vision is only slightly impaired more than by the lifting press cylinder 16 itself for the operator.

The column 6–10 of the inner mast section is supported on a crosspiece 22, on which the bottom plate 23 of the lifting press cylinder 24 is supported, from which a piston rod (not shown) is extensible. A chain roller (not shown), over which a chain (not shown), which is fastened with its inner stringer at the crosspiece 22 and is fastened with its front stringer at the fork carrier 13, is carried, is also supported on the end of the piston rod.

Four hoses 25, 26, 27 and 28 (only symbolically indicated) are carried parallel to the chain 18, such that they do not narrow the field of vision of the operator any more than the chain 18 itself. Each of these hoses is brought to a connection 29–33, which is screwed into the mouth of a horizontal borehole 34 or 35 or 36 or 37. Each of these boreholes empties into a borehole 38, also running horizontally and passing lengthwise through the web 10, in which case a connecting section 39 is screwed into each of the two upper boreholes 38, where a hose 40 is carried in each of these two connections 39, where the two hoses 40 are supported over a clamping collar 41, which is fastened to the lifting cylinder 24, and serve to supply an additional hydraulic system fastened on the lift slide with pressure medium.

The two lower boreholes 38 in the drawing are closed at their ends by a stopper. A borehole 42, also horizontal, in the mouths of which a connecting section 43 is screwed, empties in each of these boreholes 38. A hose 45 that serves to supply the lifting press cylinder 24 with pressure and medium is connected through an elbow 44 to the two connections 43. With this arrangement it is possible to supply the components that are capable of sliding with the column 6–10, together with the inner mast section, with pressure medium and to carry the hoses required parallel to the lifting chain 18 and still to come to the parts of the inner mast section without coming into the movement space of the rollers **4, 4*a* or 11** or the mast sections capable of sliding relative to each other.

If the standing mast section 1, 2 and the middle mast section with the columns 3 are left out and the columns 6–10 are fastened with the crosspiece 22 as standing mast columnns, the lifting frame that results can be used as a simple lifting frame. If the columns 6–10 are capable of sliding relatively with respect to the columns 3 and the columns 3 are established as standing mast sections, we have a duplex frame. Both the single and duplex frames can be set up with the same structural components. The individual features of the invention with respect to the arrangement of the chain and its fastening to the extensible mast section and the arrangement of the hoses and the feeding of the pressure medium into the extensible mast section can accordingly be used not only in lifting frames with standing mast sections, a middle mast section and an inner mast section (triplex frames), but accordingly also in other frames, e.g., in frames with columns corresponding to the columns 1, 3 and 6–10 shown in the implementation example, but without a lifting press cylinder connected with the farthest extensible mast section, such that the same chain conveyance and chain fastening are possible, or, if another hydraulic device to be supplied with pressure medium is provided instead of the lifting press cylinder 24, also with the hose arrangement described above.

Two different implementation forms, for two connections here, are shown in the drawing, on the one hand with the borehole 38 passing directly toward the back and the connections 39 and, on the other hand, with the borehole 38 connected by a stopper, with a lateral borehole 42. Depending on whether it is spatially more favorable in a given application, all the connections present can also be located on the rear side of the flange 6, 7 depending on the nature of the connections 39, or in the other implementation all the connections can be located on the lateral connection of the borehole 42 in the flange 7.

With the present-day production methods no difficulties are involved in effecting a long borehole 38 through the narrow web 10 so that the wall of the borehole nowhere approaches the wall of the web 10 too closely, such that it no longer has the required resistance to pressure. Each borehole of this type does indeed weaken the web somewhat, but although in the lower region 6, 7 of the column 6, 7, 8, 9 the latter is loaded by the supporting forces of the lower rollers in the fork carrier, this lower region is stressed less by the bending stress due to its distribution over the length, such that this weakening of the web and the flanges in this region is quite acceptable.

In the foregoing specification I have set out certain preferred practices and embodiments of this invention, however, it will be understood that this invention may be otherwise embodied within the scope of the following claims.

I claim:

1. In a multiply extensible lifting frame for lift loaders having a standing mast generally in a plane transverse to the central longitudinal axis of the lift loader and connected with the lift loader frame and a middle mast section capable of sliding against it and and inner, farthest extensible mast section capable of sliding against the middle mast section, each mast section having two lateral columns, a first lifting press cylinder connected with the standing mast adjacent each lateral column, a piston rod in each lifting press cylinder being capable of sliding in the lifting press cylinder connected with the middle mast section to lift the same, a first chain connected at one end with the standing mast and at the other end with the lower end of the inner mast section and carried over a roller supported on the middle mast section adjacent each lateral column to lift the inner mast section at twice the rate of the middle section, a second lifting press cylinder connected with the inner mast section, a roller supported on this second lifting press, a second chain conveyed over said rollers on the second lifting press, said chain being fastened at one of its ends at the inner mast section and having its other end fastened at the lift slide, the improvement comprising each said lifting press cylinder that is connected with the standing mast being located immediately on the outside remote from the central longitudinal axis of the loader and alongside a column of the standing mast section and within the same general plane transverse to the central longitudinal axis of the lift loader as said standing mast section, the said first chains each being carried in a plane parallel to the longitudinal median plane of the vehicle, and each of said first lifting press cylinders being in the same plane as each said first chains, and a lateral boom fastened at one end to the lower end of at least one member of each of the inner mast sections and extending outwardly therefrom and fastened at the other end to the ends of the said first chains.

2. In a multiply extensible lifting frame for lifting loaders having a standing mast connected with the lift loader frame and a middle mast section capable of sliding against it and an inner, farthest extensible mast section capable of sliding against the middle mast section, each mast section having two lateral columns, at least one lifting press cylinder connected with the standing mast, a piston rod in the lifting press cylinder being capable of sliding in the lifting press cylinder connected with the middle mast section, at least one chain connected at one end with the standing mast and at the other end with the lower end of the inner mast section and carried over a roller supported on the middle mast section, a second lifting press cylinder connected with the inner mast section, a roller supported on this second lifting press, a chain conveyed over said rollers on the second lifting press, said chain being fastened at one of its ends at the inner mast section and having its other end fastened at the lift slide, said lifting press cylinder that is connected with the standing mast being located immediately on the outside alongside a column of the standing mast section, the improvement comprising the at least one chain being carried in a plane parallel to the longitudinal median plane of the vehicle, and the at least one lifting press cylinder being in the same plane, and a lateral boom, to which the first at least one chain is fastened, is fastened at the lower end of at least one, prefereably each column of the inner mast section, wherein rollers are carried on the columns of the inner mast section, the lift slide is capable of being displaced close by the inner side or front side of the columns, and wherein hoses for one of an additional hydraulic system and the additional lifting press cylinder are carried in the same plane running parallel to the longitudinal median plane of the vehicle, in which the at least one chain is also carried, and that each hose is connected with a connection which is inserted into a borehole that empties at one end at the side of the front flange of the column of the inner mast section and which empties at the other end at the back side of the same column of the inner mast section, and a connection, to which one of a line that leads to the cylinder of the additional lifting press and a line that leads to the additional hydraulic system is connected, is threadingly screwed into the other end of the borehole.

* * * * *

UNITED STATES PATENT AND TRADEMARK OFFICE

CERTIFICATE OF CORRECTION

PATENT NO. : 4,703,834

DATED : November 3, 1987

INVENTOR(S) : KURT KNAPPE

It is certified that error appears in the above-identified patent and that said Letters Patent is hereby corrected as shown below:

Column 1, line 5, change "774064" to --774,064--.

Column 1, line 12, delete "connected with the lift loader section" and insert --and an inner extensible mast section--.

Column 1, line 24, change "innere" to --inner--.

Column 3, line 28, after "9" insert --,--.

Column 4, line 68, change the second occurrence of "and" to --an--.

Column 5, line 34, change the second occurrence of "lifting" to --lift--.

Signed and Sealed this

Fifteenth Day of March, 1988

*Attest:*

*Attesting Officer*

DONALD J. QUIGG

*Commissioner of Patents and Trademarks*